US009619806B2

(12) United States Patent
Blackhurst et al.

(10) Patent No.: US 9,619,806 B2
(45) Date of Patent: Apr. 11, 2017

(54) PEER-TO-PEER TRANSFER OF FUNDS FOR A SPECIFIED USE

(75) Inventors: Jason P. Blackhurst, Charlotte, NC (US); Dean Lyons Henry, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 266 days.

(21) Appl. No.: 13/617,627

(22) Filed: Sep. 14, 2012

(65) Prior Publication Data

US 2014/0081787 A1 Mar. 20, 2014

(51) Int. Cl.
*G06Q 30/00* (2012.01)

(52) U.S. Cl.
CPC ..... *G06Q 30/00* (2013.01)

(58) Field of Classification Search
CPC ..... G06Q 30/0601
USPC ..... 705/26.1
See application file for complete search history.

(56) References Cited

U.S. PATENT DOCUMENTS 5,974,396 A 10/1999 Anderson et al.
6,173,272 B1 * 1/2001 Thomas ..... G06Q 20/00 705/42
6,311,165 B1 10/2001 Coutts et al.
6,876,977 B1 * 4/2005 Marks ..... G06Q 30/06 705/26.62
7,099,850 B1 * 8/2006 Mann et al. ..... 705/64
7,225,156 B2 5/2007 Fisher et al.
7,246,087 B1 7/2007 Ruppelt et al.
7,512,566 B1 * 3/2009 Fellner ..... G06Q 20/367 705/44
7,542,924 B2 * 6/2009 Chow ..... G06Q 30/06 705/26.7
7,568,114 B1 7/2009 Schlafly
7,725,363 B2 5/2010 Speers et al.
7,848,980 B2 * 12/2010 Carlson ..... 705/35
8,032,427 B1 10/2011 Spreen et al.
8,036,945 B2 10/2011 Speers et al.
8,127,982 B1 * 3/2012 Casey et al. ..... 235/379
(Continued)

OTHER PUBLICATIONS

Squidoo, LLC, "Introducing MobillCash: Make a Secure Sale Even When an Online Customer Has No Cash, Credit Cards or I.D.," located at http://www.squidoo.com/mobillcash-pay-by-mobile-phone, available at least by Aug. 29, 2008.*

*Primary Examiner* — Alexis Casey
(74) *Attorney, Agent, or Firm* — Michael A. Springs; Moore & Van Allen PLLC; Peter B. Stewart

(57) ABSTRACT

Embodiments of the invention are directed to systems, methods and computer program products for providing a system for a peer-to-peer transfer of funds for a specified purpose. An exemplary apparatus is configured to: receive information from a user relating to a peer-to-peer transfer of funds, wherein the information comprises a recipient and a specified use; identify at least one recipient account for the recipient; receive information associated with a transaction; determine the transaction qualifies for the specified use; and apply funds associated with the peer-to-peer transfer to the transaction. The specified purpose may be use at a specific merchant, use to purchase a specific product, or other types of specified uses. Computer program products and methods are also provided.

8 Claims, 7 Drawing Sheets

(56) References Cited

U.S. PATENT DOCUMENTS

| | | | | |
|---|---|---|---|---|
| 8,453,940 | B2 | 6/2013 | Diamond | |
| 8,467,766 | B2 * | 6/2013 | Rackley et al. | 455/406 |
| 8,515,874 | B2 * | 8/2013 | Blair | G06Q 10/02 705/64 |
| 8,516,255 | B2 | 8/2013 | Roberts et al. | |
| 8,583,554 | B2 * | 11/2013 | Dooley Maley et al. | 705/41 |
| 8,589,236 | B2 | 11/2013 | Afana | |
| 8,589,288 | B1 | 11/2013 | Meyer et al. | |
| 9,092,817 | B2 * | 7/2015 | Allocca | G06Q 20/203 |
| 2002/0052841 | A1 * | 5/2002 | Guthrie et al. | 705/40 |
| 2003/0200162 | A1 | 10/2003 | Challener | |
| 2005/0222854 | A1 * | 10/2005 | Dale et al. | 705/1 |
| 2005/0222944 | A1 * | 10/2005 | Dodson et al. | 705/39 |
| 2006/0218086 | A1 * | 9/2006 | Campbell et al. | 705/39 |
| 2007/0194113 | A1 * | 8/2007 | Esplin | G06Q 20/10 235/383 |
| 2007/0255653 | A1 * | 11/2007 | Tumminaro et al. | 705/39 |
| 2008/0059486 | A1 | 3/2008 | Pappas | |
| 2008/0195499 | A1 | 8/2008 | Meredith et al. | |
| 2009/0012704 | A1 | 1/2009 | Franco et al. | |
| 2009/0144193 | A1 * | 6/2009 | Giordano | G06Q 20/04 705/39 |
| 2009/0276359 | A1 * | 11/2009 | Panthaki | G06Q 20/10 705/44 |
| 2009/0287600 | A1 * | 11/2009 | Amorosa et al. | 705/39 |
| 2009/0313147 | A1 | 12/2009 | Balasubramanian et al. | |
| 2009/0319425 | A1 * | 12/2009 | Tumminaro et al. | 705/42 |
| 2011/0213671 | A1 | 9/2011 | Hirson et al. | |
| 2012/0078788 | A1 * | 3/2012 | Gandhi | 705/44 |
| 2012/0084205 | A1 * | 4/2012 | Dheer et al. | 705/42 |
| 2012/0259779 | A1 | 10/2012 | Bharghavan et al. | |
| 2012/0330971 | A1 | 12/2012 | Thomas et al. | |

* cited by examiner

PEER-TO-PEER TRANSFER OF FUNDS FOR A SPECIFIED USE

BACKGROUND

A gift card is a monetary amount that is issued by a merchant to be redeemed for purchases associated with merchants. Not all merchants, however, offer gift cards. There is a need for updating the process of how gift cards work.

BRIEF SUMMARY

Embodiments of the invention are directed to systems, methods, and computer program products for providing a peer-to-peer transfer of funds for a specified use. In an embodiment, the specified use is for use at a merchant. In some embodiments, an apparatus is provided for providing a peer-to-peer transfer of funds for a specified use. The apparatus includes a memory; a processor; and a module stored in the memory, executable by the processor, and configured to: receive information from a user relating to a peer-to-peer transfer of funds, wherein the information comprises a recipient and a specified use; identify at least one recipient account for the recipient; receive information associated with a transaction; determine the transaction qualifies for the specified use; and apply funds associated with the peer-to-peer transfer to the transaction.

In an embodiment, the specified use is use at a specific merchant, wherein the information includes identifying indicia for the merchant. In another embodiment, the specified use is use for a specific product.

In some embodiments, the information received from the user further comprises an amount. For example, the amount may be a maximum amount.

In an embodiment, the funds are applied to the transaction through a payment method comprising at least one of a payment card payment, an electronic funds transfer, and a mobile device payment.

In a further embodiment, applying funds associated with the peer-to-peer transfer to the transaction includes in response to determining an amount associated with the transaction is greater than an amount associated with the peer-to-peer transfer, applying funds associated with the peer-to-peer transfer to the transaction, and applying general funds associated with the user to a remainder of the transaction.

In an aspect, a computer program product for providing a peer-to-peer transfer of funds for a specified use is provided. The computer program product includes a non-transitory computer-readable medium comprising a set of codes for causing a computer to: receive information from a user relating to a peer-to-peer transfer of funds, wherein the information comprises a recipient and a specified use; identify at least one recipient account for the recipient; receive information associated with a transaction; determine the transaction qualifies for the specified use; and apply funds associated with the peer-to-peer transfer to the transaction.

In an embodiment, the specified use is use at a specific merchant, wherein the information includes identifying indicia for the merchant. In another embodiment, the specified use may be use for a specific product.

In another embodiment, the information received from the user further comprises an amount, such as a maximum amount.

In a still further embodiment, the funds are applied to the transaction through a payment method comprising at least one of a payment card payment, an electronic funds transfer, and a mobile device payment.

In some embodiments, applying funds associated with the peer-to-peer transfer to the transaction includes in response to determining an amount associated with the transaction is greater than an amount associated with the peer-to-peer transfer, applying funds associated with the peer-to-peer transfer to the transaction, and applying general funds associated with the user to a remainder of the transaction.

In a further aspect, a method for providing a peer-to-peer transfer of funds for a specified use is provided. The method includes receiving information from a user relating to a peer-to-peer transfer of funds, wherein the information comprises a recipient and a specified use; identifying at least one recipient account for the recipient; receiving information associated with a transaction; determining, via a computing device processor, that the transaction qualifies for the specified use; and applying funds associated with the peer-to-peer transfer to the transaction.

In an embodiment, the specified use is use at a specific merchant, wherein the information includes identifying indicia for the merchant. In another embodiment, the specified use is use for a specific product.

In some embodiments, the information received from the user further comprises an amount. For example, the amount may be a maximum amount.

In an embodiment, applying funds associated with the peer-to-peer transfer to the transaction includes in response to determining an amount associated with the transaction is greater than an amount associated with the peer-to-peer transfer, applying funds associated with the peer-to-peer transfer to the transaction, and applying general funds associated with the user to a remainder of the transaction.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
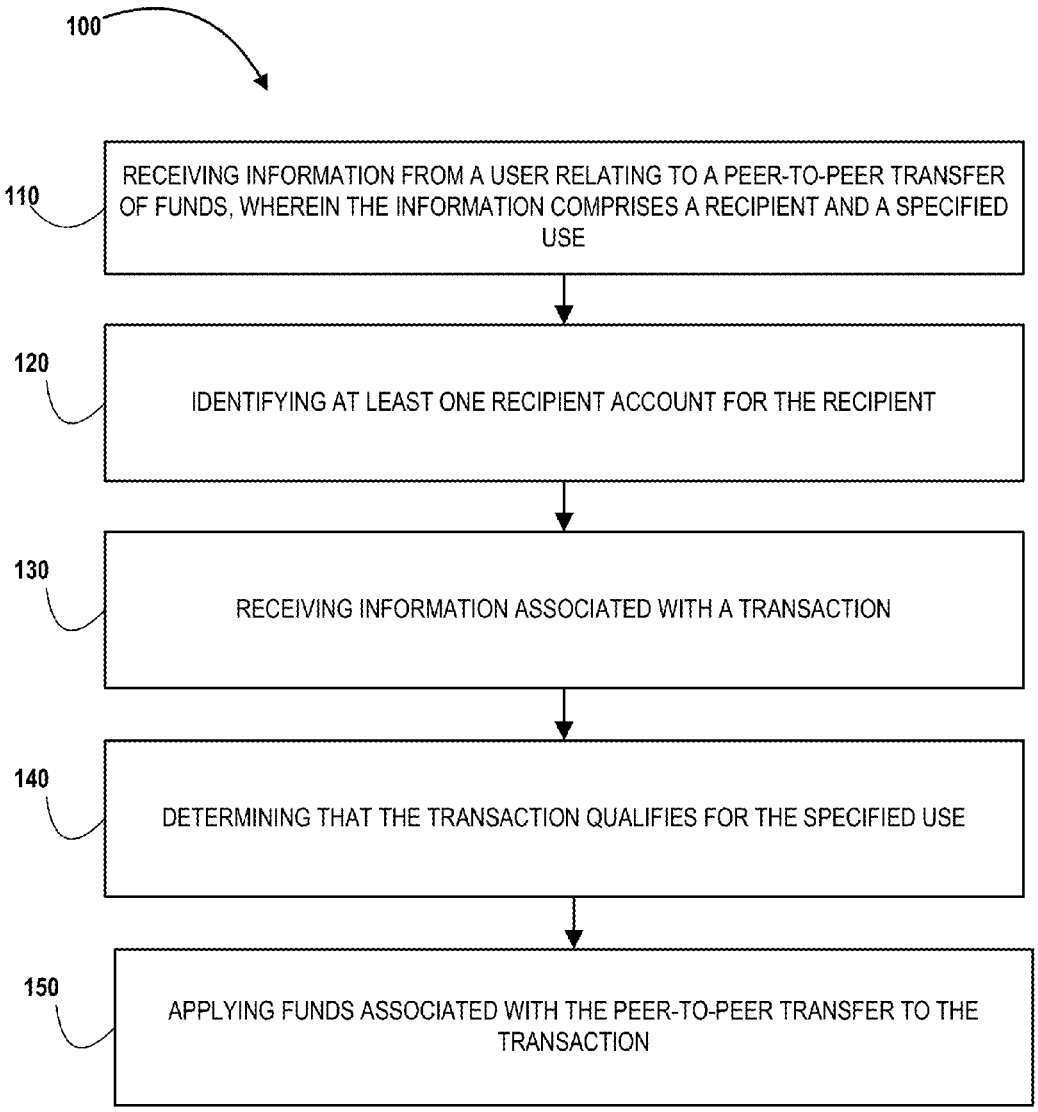
Figure 2:
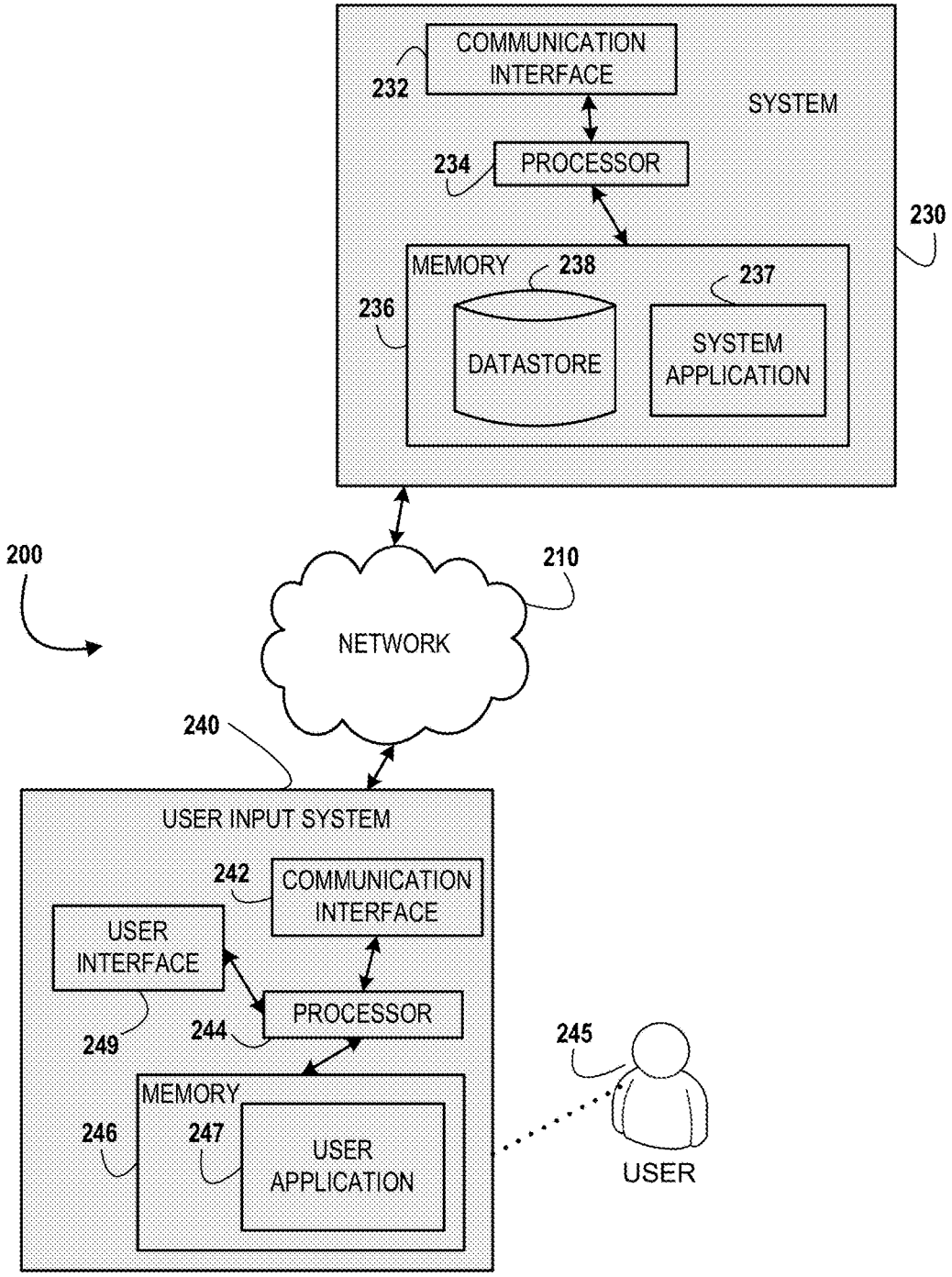
Figure 3:
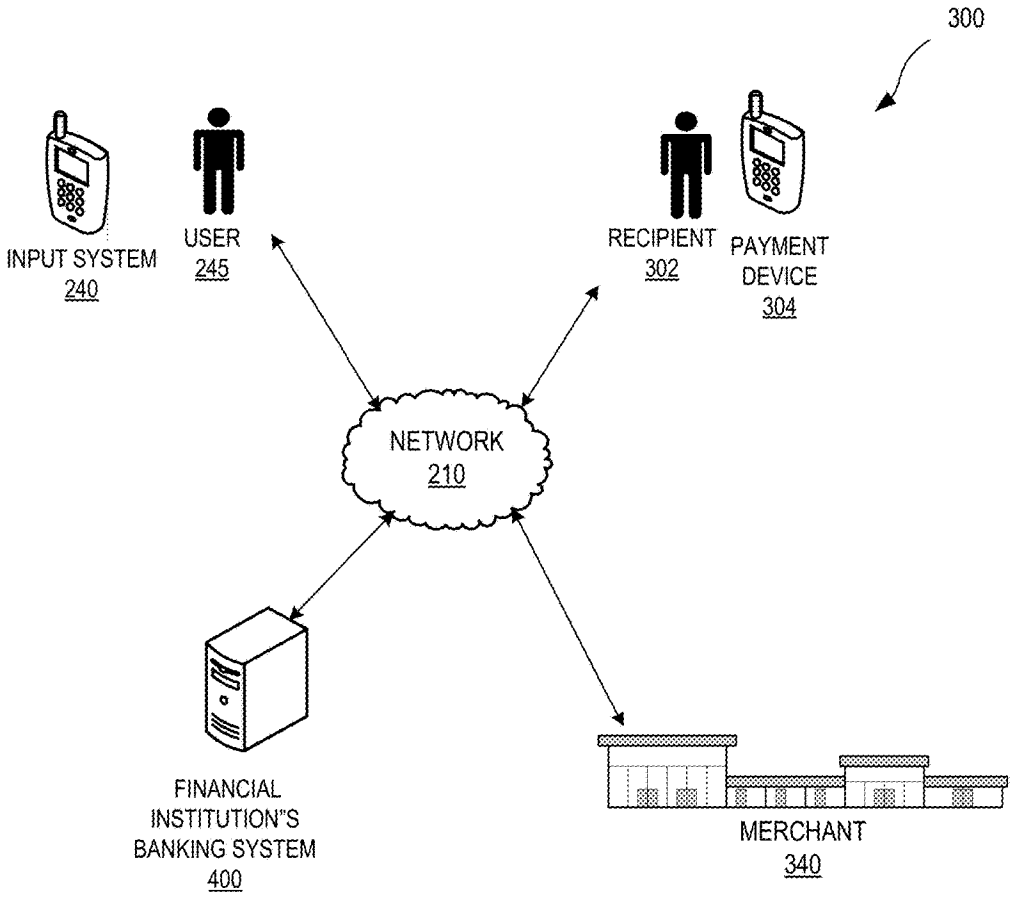

Having thus described embodiments of the invention in general terms, reference will now be made to the accompanying drawings, where:

FIG. 1 is a flowchart illustrating a general process flow for providing a peer-to-peer transfer of funds for a specified purpose, in accordance with embodiments of the present invention;

FIG. 2 is a block diagram illustrating technical components of a system for implementing the various processes described herein, in accordance with embodiments of the present invention;

FIG. 3 provides a block diagram illustrating a peer-to-peer fund transfer system and environment in accordance with various embodiments of the invention; and FIGS. 4-7 are exemplary user interfaces for implementing peer-to-peer transfer of funds for a specified use, in accordance with embodiments of the present invention.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout. Additionally, while embodiments are disclosed as "comprising" elements, it should be understood that the embodiments may also "consist of" elements or "consist essentially of" elements.

Embodiments of the invention are directed to systems, methods and computer program products for providing peer-to-peer transfer of funds for a specified use. An exemplary system is configured to receive information from a user relating to a peer-to-peer transfer of funds, wherein the information comprises a recipient and a specified use; identify at least one recipient account for the recipient; receive information associated with a transaction; determine the transaction qualifies for the specified use; and apply funds associated with the peer-to-peer transfer to the transaction.

Therefore, the present invention enables a user to transfer funds for a specific use to a recipient, such as a family member or friend, a business entity, or a charitable cause. In an exemplary embodiment, the specific use is as a virtual gift card at a merchant. User may use this system to provide virtual gift cards to merchants that do not support (e.g., provide or recognize) standard gift cards. The invention enables the user to efficiently use the funds associated with the peer-to-peer transfer. Additionally, the invention enables a user to create peer-to-peer transfers for a variety of specified uses (e.g., use to purchase a specific product or service, limitations on dates of use, and the like).

In some embodiments, the "user" may be a customer (e.g., an account holder or a person who has an account (e.g., banking account, credit account, or the like) at the entity) or a potential customer (e.g., a person who has submitted an application for an account, a person who is the target of marketing materials that are distributed by the entity, a person who applies for a loan that not yet been funded, or the like). Additionally, the user may be a person desiring to complete a peer-to-peer transfer of funds for a specified purpose.

In some embodiments, a recipient may be a customer or a potential customer of a financial institution. The recipient may be an individual, a corporate or non-profit entity, or a group of individuals (e.g., a joint account owned by a family). In an embodiment, the recipient has a financial account at a financial institution to which the peer-to-peer transfer of funds may be applied. While transfers are referred to as peer-to-peer transfers, it should be understood that users and recipients do not need to be of the same category. For example, a user may transfers funds via a peer-to-peer transfer to a corporate recipient. Similarly, a non-profit organization may transfer funds to an individual person. In both cases, and numerous similar cases, the transfer is deemed a peer-to-peer transfer.

In some embodiments, an "entity" or "organization" may be a financial institution. For the purposes of this invention, a "financial institution" may be defined as any organization, entity, or the like in the business of moving, investing, or lending money, dealing in financial instruments, or providing financial services. This may include commercial banks, thrifts, federal and state savings banks, savings and loan associations, credit unions, investment companies, insurance companies and the like. In some embodiments, the entity may allow a user to establish an account with the entity. An "account" may be the relationship that the user has with the entity. Examples of accounts include a deposit account, such as a transactional account (e.g., a banking account), a savings account, an investment account, a money market account, a time deposit, a demand deposit, a pre-paid account, a debit account, a credit account, a non-monetary user profile that includes only personal information associated with the user, or the like. The account is associated with and/or maintained by the entity. In other embodiments, an entity may not be a financial institution.

Referring now to FIG. 1, a general process flow 100 is provided for implementing peer-to-peer fund transfer for a specified purpose. At block 110, the system receives information from a user relating to a peer-to-peer transfer of funds, wherein the information includes a recipient and a specified use. At block 120, the system identifies at least one recipient account for the recipient. At block 130, the system receives information association with a transaction. At block 140, the system determines that the transaction qualifies for the specified use. At block 150, the system applies funds associated with the peer-to-peer transfer to the transaction.

The system (e.g., a system associated with the financial institution) is configured to apply funds associated with the peer-to-peer transfer for a specified use with a transaction that qualifies for the specified use. A transaction qualifies for the specified use when the conditions defined by the user are met by the transaction. For example, the user may specify that the funds are to be used at a specific merchant. When the recipient conducts a transaction at the specific merchant, the funds are applied to the transaction. As should be understood, numerous specified uses may be defined by the user. For example, use to purchase a specific product or service, use to donate a specific amount of money to a non-profit or charitable organization, use during a specific time period or location, may be uses for the funds specified by the user.

Turning again to block 110, the system receives information from the user. The user may enter information into an input device, such as a mobile device, a computer, a website, or a kiosk at a financial institution to initiate the peer-to-peer transfer of funds for a specified purpose. As discussed, the information includes the recipient and the specified use for the funds. The information may also include additional information, such as the account from which the funds will be transferred, the amount of the transfer, the date and/or time of the transfer, a maximum transfer amount, whether an alert should be sent to the user and/or recipient when the funds transfer or are used, and the like. In an embodiment, the financial institution hosting the user's account from which the funds will be transferred is notified of the requested transfer. Communication between the user, the financial institution hosting the user's account and the financial institution hosting the recipient's account occurs over a network.

The peer-to-peer transfer of funds may occur automatically and substantially immediately upon the user's request or the peer-to-peer transfer of funds may be delayed. For example, the peer-to-peer transfer of funds may be delayed until sufficient funds are available in the user's account or until the recipient conducts a qualifying transaction. In an embodiment, funds may not be transferred to the recipient at all. For example, the user may initiate a peer-to-peer transfer of funds for a specified purpose such that the debit is applied to the user's account instead of the recipient's account when the recipient conducts a qualifying transaction. The user may allow a transaction debit to be applied to the user's credit card balance when a recipient conducts a qualifying transaction.

The recipient is identified from the information provided by the user. For example, the user may provide information that identifies a recipient by name, by account number, or by alias (e.g., a phone number or email address associated with an account). Identifying indicia may be used to identify the recipient. For example, a bar code or QR code may be used to identify a business to which the user desires to transfer funds. In an embodiment, the financial institution system assists the user in identifying the recipient. For example, the financial institution may provide recipient names based on the user's transaction history. Often users transfer funds to recipients multiple times and this transfer is recorded in the transaction history. In another embodiment, the financial institution assists users in searching for recipients based on recipient name, location, or other demographic information. In a still further embodiment, the user's input device is able to search for nearby devices and identify recipients based on wireless connection to nearby recipient devices.

The user also provides information on the specified use. The user may provide information based on default specified uses, such as at merchants or for specific products. The user may provide information on general specified uses, such as category codes for merchants or keywords in a merchant or transaction name. In an embodiment, the system identifies the recipient and/or recipient account and assists the user in identifying specific uses. For example, the system may determine the grocery store that the recipient most often shops at based on the recipient transaction history and then allow the user to provide a peer-to-peer transfer of funds for use at the recipient's preferred grocery store. In some embodiments, the system provides hierarchical drop down menus that direct the user through general categories to more specific categories for selecting specified uses.

In an embodiment, the user's specified use is for use at a specific merchant. The specified merchant may be identified based on merchant name, tax ID number, or location. The specified use may be for at any store associated with the specific merchant. Alternatively, the specified use may be for a specific store associated with the specific merchant. For example, a merchant may have multiple stores in multiple cities. The user may specify that a qualifying transaction can occur at any (or all) of the stores or may specify that a qualifying transaction can occur at only a specific store in a specific city. In an embodiment, the system provides drop-down menus for merchants and stores identified based on category, name, keyword, location, or some other searchable feature (e.g., reviews, ranking, and the like).

In some embodiments, the specified use is for use in a specific category. The categories may be classified based on transaction information, such as merchant category code, or based on keyword in the merchant name, such as grocery. For example, the user may specify that peer-to-peer transfer of funds may be used for transactions at grocery stores. The categories may be defined by the user or suggested by the system. For example, a financial institution may provide general categories that the user can select as specified uses. The financial institution may aggregate a variety of merchants and/or services under different categories, e.g., home improvement, groceries, automobile, and the like. Rather than trying to determine the appropriate merchant or merchant category code for a desired use, the user is able to select the predefined categories provided by the system so that recipients can make qualifying transactions at home improvement stores, grocery stores, or gas stations and auto repair shops, for example.

In a further embodiment, the user's specified use may be for a specific product or service. In some embodiments, the specific product or service purchased during a transaction is identified by SKU level data associated with the transaction. For example, the user may transfer funds to a recipient for use to purchase a television, such as for a gift. The recipient may go to a store and purchase a television, a DVD player, and a TV stand. The transaction receipt may include an indication, such as a SKU code, indicating that a television was purchased. The system would therefore determine that at least a portion of the transaction qualified for the peer-to-peer transfer of funds. In an embodiment, a receipt may also be analyzed, such as an email receipt, to indicate the products that were purchased and the prices for each product.

In some embodiments, the user provides a specific or general location as a specified use. For example, the user may indicate that the recipient may use funds when present at a specific location, e.g., a school. In an embodiment, the system determines the location of the transaction based on information received from the merchant. In another embodiment, the system determines the location based on information received from the payment device, e.g., the recipient's mobile payment device may include a geopositioning system such as a GPS device. The location may be general, such as anywhere within a city, or the location may be more specific, such as a specific building within a city. In an embodiment, the system accepts addresses, names, or other types of coordinates from the user to determine qualifying transactions. In another embodiment, the system provides a search and/or mapping feature to assist the user in defining qualifying locations.

In some embodiments, the specified use is based on recipient behavior. In one embodiment, the specified use is based on the number and/or frequency of transactions conducted by the recipient. For example, the user may specify that the peer-to-peer transfer of funds be available for a transaction after the recipient conducts a predetermined number of transactions at a specific merchant. In another embodiment, the transaction history of the recipient is evaluated in order to determine a specified use. For example, the user may specify that the peer-to-peer transfer of funds be used for a transaction at the recipient's most recent or most frequent restaurant purchase. In this manner, the user is able to provide a virtual gift card to a restaurant that the recipient frequents based on the recipient's transaction history. In a still further embodiment, the peer-to-peer transfer of funds is qualified based on the account balance of the recipient. For example, the peer-to-peer transfer of funds may be available when the recipient account balance reaches a predetermined minimum or maximum. In some embodiments, the recipient must opt in to allow the system to access the recipient's transaction history and account data.

In a still further embodiment, the user provides a date and/or time that the transaction must meet in order to be a qualifying transaction. The date and/or time may be a specific date or time or may be a range of dates and times. For example, the use may specify that the recipient must conduct a transaction between Friday at 5 pm and Sunday at 10 pm for the transaction to qualify for the fund transfer.

As part of the specified use, the peer-to-peer transfer of funds may or may not have an expiry date. If the peer-to-peer transfer of funds has an expiry date, funds associated with the peer-to-peer transfer of funds may not be utilized after the expiry date for any transactions executed by the recipient. In an embodiment, funds that are not used by the expiry date are returned to the user.

In an embodiment, the information also includes an amount. For example, an amount of the peer-to-peer transfer may be specified by the user. In another embodiment, the information includes a maximum amount. For example, the user may desire to provide a transfer of funds to allow an individual to purchase a crib at a merchant. The user may not know the cost of the crib and therefore sets a maximum amount. When the recipient conducts a transaction that qualifies for the peer-to-peer transfer of funds, the system transfer sufficient funds up to the maximum from the user account to the recipient account in order to pay for the crib. In another embodiment, the amount is a specified use and includes a minimum amount, such that a transaction must be a minimum amount before it qualifies for the funds, or the amount is a specified use and includes an exact amount, such that the transaction must be the exact amount before the transaction qualifies for the funds.

In a further embodiment, the system suggests alternative specified uses. For example, the system may determine that the user and/or recipient can save money by using a preferred merchant, e.g., a merchant with which the financial institution has a relationship, compared the merchant originally selected by the user. The system may propose to the user that the specified use include the preferred merchant in addition to or instead of the originally-selected merchant.

It should be understood that the user may specify detailed uses included more than one of the aforementioned criteria. For example, a user may specify that transferred funds may be used to purchase a specific item at a specific merchant on a specific date.

Turning now to block 120, the system identifies at least one account for the recipient. The account may be a single financial account, such as a debit card or credit card account. In another embodiment, the system identifies multiple accounts for the recipient. For example, the system may identify all accounts capable of conducting transactions for the recipient. In one embodiment, the system identifies accounts at a single financial institution but in another embodiment the system identifies multiple accounts over different financial institutions.

In an embodiment, the system notifies the recipient when the user has made a peer-to-peer transfer of funds for a specified purpose. In an embodiment, the system provides the user name, the amount, and/or details regarding the specified purpose. In another embodiment, the user may also include a personal note in the notification. In some embodiments, the recipient may reject the peer-to-peer transfer of funds for a specified purpose or may provide a notification back to the user, such as a thank you note or a question.

The recipient may have multiple accounts accessible by the system. For example, the system may have both a credit card account and a checking card account with a financial institution. When the user indicates that a peer-to-peer transfer of funds should occur, the transfer of funds may apply to all accounts of the user. In this example, the transferred funds would be applied to a transaction that occurs at any or all of the recipient's accounts. The user may transfer $100, for example, to the recipient for use at a specific store. The recipient may use the credit card at the specific store on day 1 and apply $50 of the transferred funds to a transaction. On day 2, the recipient returns to the specific store and applies the remaining $50 to a second transaction using the checking card account. In one embodiment, the transferred funds are used to completely cover qualifying transactions, while in another embodiment the recipient is capable of selecting how much of the transferred funds are to be applied to a qualifying transaction and then may make up the difference using general funds.

In block 130, the system receives information associated with a transaction. A transaction is executed by a recipient using a payment method associated with the account. Since the peer-to-peer fund transfer has been integrated into the account, the transaction is not executed using the user's account but rather the recipient's account. The payment method comprises at least one of a payment card payment, an electronic funds transfer, or a mobile device payment. The payment methods are not limited to those described herein. The system may receive the information from the merchant, financial institution, or payment device. The information may include the merchant name, the location, the time and/or date, the specific products purchased, the amount, a breakdown of the cost for each item or service purchased, and the like.

In block 140, the system determines whether the transaction qualifies for the specified use. In an embodiment, the system compares the information associated with the transaction with the use specified by the user to determine if the transaction or a part of the transaction qualifies for the peer-to-peer transfer of funds.

In block 150, the system applies funds associated with the peer-to-peer transfer to the transaction. In an embodiment, applying funds comprises determining whether an amount of the transaction is greater than an amount associated with the peer-to-peer transfer of funds. If the amount associated with the transaction is not greater than (e.g., less than or equal to) the amount associated with the peer-to-peer transfer, the funds associated with the peer-to-peer transfer are applied to the transaction. Consequently, the peer-to-peer transfer balance is reduced. If the amount associated with the transaction is greater than the amount associated with the peer-to-peer transfer, the funds associated with the peer-to-peer transfer are applied to the transaction, and general funds (e.g., non-transfer funds) associated with the account are applied to the remainder of the transaction. Therefore, the peer-to-peer transfer balance is reduced to zero.

When a transaction qualifies for a peer-to-peer transfer, funds associated with the peer-to-peer transfer are applied to the transaction. Therefore, when a recipient views (e.g., on the on the recipient's account) a peer-to-peer transfer balance immediately after the transaction, the peer-to-peer transfer balance is reduced. Alternatively, when a transaction qualifies for a peer-to-peer transfer, general funds (and not gift card funds) associated with the account are applied to the transaction. Therefore, when a recipient views a peer-to-peer transfer balance immediately after the transaction, the peer-to-peer transfer balance is not reduced, but the general fund's balance is reduced. When processing the transaction at a predetermined time in the future, the peer-to-peer transfer balance is reduced by the amount of the transaction, and the general fund's balance is increased by the amount of the transaction.

In an embodiment, the system is configured to communicate with the user when redeeming the peer-to-peer transfer funds. For example, the user may receive an alert that the recipient used the peer-to-peer transfer funds. The user may also receive an alert that the peer-to-peer transfer has expired prior to use. The user may receive an alert that the full balance of the peer-to-peer transfer funds has been used.

The funds associated with the peer-to-peer transfer may be referred to as peer-to-peer transfer funds. In some embodiments, the system is configured to add a predetermined amount of extra funds to the peer-to-peer transfer funds. The system may be configured to add the predetermined amount of extra funds immediately after the user integrates the peer-to-peer transfer into the recipient's account, or a predetermined period after the user integrates the peer-to-peer transfer into the account. This may serve as an incentive to the user to utilize the invention described herein.

The user may associate multiple peer-to-peer transfers with the user's account. The system may enable the user to organize the multiple peer-to-peer transfer to different recipients. For example, the system may enable the user to group peer-to-peer transfers associated with a certain type (e.g., home furnishings), a certain location (e.g., a certain mall, zip code, or the like), a certain amount, a certain expiry date, a group of recipients (e.g., children, coworkers), or the like. For example, a recipient account may be a joint account associated with a husband and a wife.

As used herein, the recipient account may be a financial institution account. Alternatively, the recipient account may be a social networking account. Alternatively, the recipient account may be a merchant account associated with the recipient. A merchant account is an account established by the recipient associated with the merchant (e.g., a recipient account established on the merchant's website).

Referring now to FIG. 2, an exemplary block diagram of the system environment 200 for implementing the process flow 100 described in FIG. 1 is provided, in accordance with embodiments of the present invention. As illustrated, the system environment 200 includes a network 210, a system 230, and a user input system 240. Also shown in FIG. 2 is a user 245 of the user input system 240. The user input system 240 may be a computing device, such as a laptop computer, desktop computer, kiosk in a banking facility, or other computing device. The user input system 240 may also be a mobile device (e.g., a portable mobile communication device) described herein. The user 245 may be a person who uses the user input system 240 to execute a user application 247. The system 230 may be the external server described herein. The user application 247 and/or the system application 237 may incorporate one or more parts of the process flow 100 or any other function described herein. The user 245 may use the user input system 240 to upload information associated with a peer-to-peer transfer of funds for a specified purpose to the user's account, such as the recipient and/or the purpose. The system 230 may process information associated with the peer-to-peer transfer of funds for the specified purpose, associate the peer-to-peer transfer of funds with the recipient's account, debit the user's account, process transactions associated with the account, or the like.

As shown in FIG. 2, the system 230, and the user input system 240 are each operatively and selectively connected to the network 210, which may include one or more separate networks. In addition, the network 210 may include a local area network (LAN), a wide area network (WAN), and/or a global area network (GAN), such as the Internet. The network may also include a mobile telecommunication network. It will also be understood that the network 210 may be secure and/or unsecure and may also include wireless and/or wireline and/or optical interconnection technology.

The user input system 240 may include any computerized apparatus that can be configured to perform any one or more of the functions of the user input system 240 described and/or contemplated herein. For example, the user 245 may use the user input system 240 to transmit and/or receive information or commands to and from the system 230. In some embodiments, for example, the user input system 240 may include a personal computer system, a mobile computing device, a personal digital assistant, a mobile phone, a network device, and/or the like. As illustrated in FIG. 2, in accordance with some embodiments of the present invention, the user input system 240 includes a communication interface 242, a processor 244, a memory 246 having an user application 247 stored therein, and a user interface 249. In such embodiments, the communication interface 242 is operatively and selectively connected to the processor 244, which is operatively and selectively connected to the user interface 249 and the memory 246. In some embodiments, the user 245 may use the user application 247 to execute processes described with respect to the process flows described herein.

Each communication interface described herein, including the communication interface 242, generally includes hardware, and, in some instances, software, that enables the user input system 240, to transport, send, receive, and/or otherwise communicate information to and/or from the communication interface of one or more other systems on the network 210. For example, the communication interface 242 of the user input system 240 may include a wireless transceiver, modem, server, electrical connection, and/or other electronic device that operatively connects the user input system 240 to another system such as the system 230. The wireless transceiver may include a radio circuit to enable wireless transmission and reception of information.

Each processor described herein, including the processor 244, generally includes circuitry for implementing the audio, visual, and/or logic functions of the user input system 240. For example, the processor may include a digital signal processor device, a microprocessor device, and various analog-to-digital converters, digital-to-analog converters, and other support circuits. Control and signal processing functions of the system in which the processor resides may be allocated between these devices according to their respective capabilities. The processor may also include functionality to operate one or more software programs based at least partially on computer-executable program code portions thereof, which may be stored, for example, in a memory device, such as in the user application 247 of the memory 246 of the user input system 240.

Each memory device described herein, including the memory 246 for storing the user application 247 and other information, may include any computer-readable medium. For example, memory may include volatile memory, such as volatile random access memory (RAM) having a cache area for the temporary storage of information. Memory may also include non-volatile memory, which may be embedded and/or may be removable. The non-volatile memory may additionally or alternatively include an EEPROM, flash memory, and/or the like. The memory may store any one or more of pieces of information and data used by the system in which it resides to implement the functions of that system.

As shown in FIG. 2, the memory 246 includes the user application 247. In some embodiments, the user application 247 includes an interface for communicating with, navigating, controlling, configuring, and/or using the user input system 240. In some embodiments, the user application 247 includes computer-executable program code portions for instructing the processor 244 to perform one or more of the functions of the user application 247 described and/or contemplated herein. In some embodiments, the user application 247 may include and/or use one or more network and/or system communication protocols.

Also shown in FIG. 2 is the user interface 249. In some embodiments, the user interface 249 includes one or more output devices, such as a display and/or speaker, for presenting information to the user 245. In some embodiments, the user interface 249 includes one or more input devices, such as one or more buttons, keys, dials, levers, directional pads, joysticks, accelerometers, controllers, microphones, touchpads, touchscreens, haptic interfaces, microphones, scanners, motion detectors, cameras, and/or the like for receiving information from the user 245. In some embodiments, the user interface 249 includes the input and display devices of a mobile device, which are operable to receive and display information.

FIG. 2 also illustrates a system 230, in accordance with an embodiment of the present invention. The system 230 may include any computerized apparatus that can be configured to perform any one or more of the functions of the system 230 described and/or contemplated herein. In accordance with some embodiments, for example, the system 230 may include a computer network, an engine, a platform, a server, a database system, a front end system, a back end system, a personal computer system, and/or the like. Therefore, the system 230 may be an external server as described herein. The system may be associated with (e.g., managed by) at least one of a financial institution, a merchant, or any other entity. In some embodiments, such as the one illustrated in FIG. 2, the system 230 includes a communication interface 232, a processor 234, and a memory 236, which includes a system application 237 and a data store 238 stored therein. As shown, the communication interface 232 is operatively and selectively connected to the processor 234, which is operatively and selectively connected to the memory 236.

It will be understood that the system application 237 may be configured to implement any one or more portions of the various user interfaces and/or process flow described herein. The system application 237 may interact with the user application 247. It will also be understood that, in some embodiments, the memory includes other applications. It will also be understood that, in some embodiments, the system application 237 is configured to communicate with the data store 238, the user input system 240, or the like.

It will be further understood that, in some embodiments, the system application 237 includes computer-executable program code portions for instructing the processor 234 to perform any one or more of the functions of the system application 237 described and/or contemplated herein. In some embodiments, the system application 237 may include and/or use one or more network and/or system communication protocols.

In addition to the system application 237, the memory 236 also includes the data store 238. As used herein, the data store 238 may be one or more distinct and/or remote data stores. In some embodiments, the data store 238 is not located within the system and is instead located remotely from the system. In some embodiments, the data store 238 stores information or data described herein.

It will be understood that the data store 238 may include any one or more storage devices, including, but not limited to, data stores, databases, and/or any of the other storage devices typically associated with a computer system. It will also be understood that the data store 238 may store information in any known way, such as, for example, by using one or more computer codes and/or languages, alphanumeric character strings, data sets, figures, tables, charts, links, documents, and/or the like. Further, in some embodiments, the data store 238 may include information associated with one or more applications, such as, for example, the system application 237. It will also be understood that, in some embodiments, the data store 238 provides a substantially real-time representation of the information stored therein, so that, for example, when the processor 234 accesses the data store 238, the information stored therein is current or substantially current.

It will be understood that the embodiment of the system environment illustrated in FIG. 2 is exemplary and that other embodiments may vary. As another example, in some embodiments, the system 230 includes more, less, or different components. As another example, in some embodiments, some or all of the portions of the system environment 200 may be combined into a single portion. Likewise, in some embodiments, some or all of the portions of the system 230 may be separated into two or more distinct portions.

In addition, the various portions of the system environment 200 may be maintained for and/or by the same or separate parties. It will also be understood that the system 230 may include and/or implement any embodiment of the present invention described and/or contemplated herein. For example, in some embodiments, the system 230 is configured to implement any one or more of the embodiments of the process flow 100 described and/or contemplated herein in connection with FIG. 1 or any other process flow described herein. Additionally, the system 230 is configured to initiate presentation of any of the user interfaces described herein.

FIG. 3 provides a block diagram illustrating a peer-to-peer fund transfer system and environment 300, in accordance with an embodiment of the invention. As illustrated in FIG. 3, the peer-to-peer fund transfer environment 300 includes a user 245 and a user input system 240. The environment 300 may also include a recipient 302 having a payment device 304. The payment device 304 may include payment vehicles such as check, credit card, mobile payments, EFT transfer, reward point payments, person-to-person, person-to-merchant, and the like.

The environment may also include an entity associated with the specified use. For example, if the specified use is use at a specific merchant 340, then the environment may include the specific merchant 340. The merchant may be a brick-and-mortar merchant, a mobile merchant, or an online merchant. The entity may be a non-profit organization or charity. The entity may be a financial institution, such as a bank or investment advisor. In an embodiment, the specified use may be use to purchase a specific product or service. In this embodiment, the entity would be a merchant or organization that provides the specific product or service.

In an embodiment, the environment 300 also includes at least one financial institution banking system 400. In some embodiments, the banking system 400 includes authentication of the user in order to access the user's account on the banking system 400. For example, the banking system 400 may be a system where the user 245 logs into his/her account such that the user 245 or other entity can access data that is associated with the user 245. For example, in one embodiment of the invention, the banking system 400 is a mobile banking system maintained by a financial institution. In such an embodiment, the user 245 can log into the mobile banking system to access the user's financial accounts and in some cases implement the peer-to-peer transfer request. Logging into the banking system 400 generally requires that the user 245 authenticate his/her identity using a user name, a passcode, a cookie, a biometric identifier, a private key, a token, and/or another authentication mechanism that is provided by the user 245 to the banking system 400.

Figure 5:
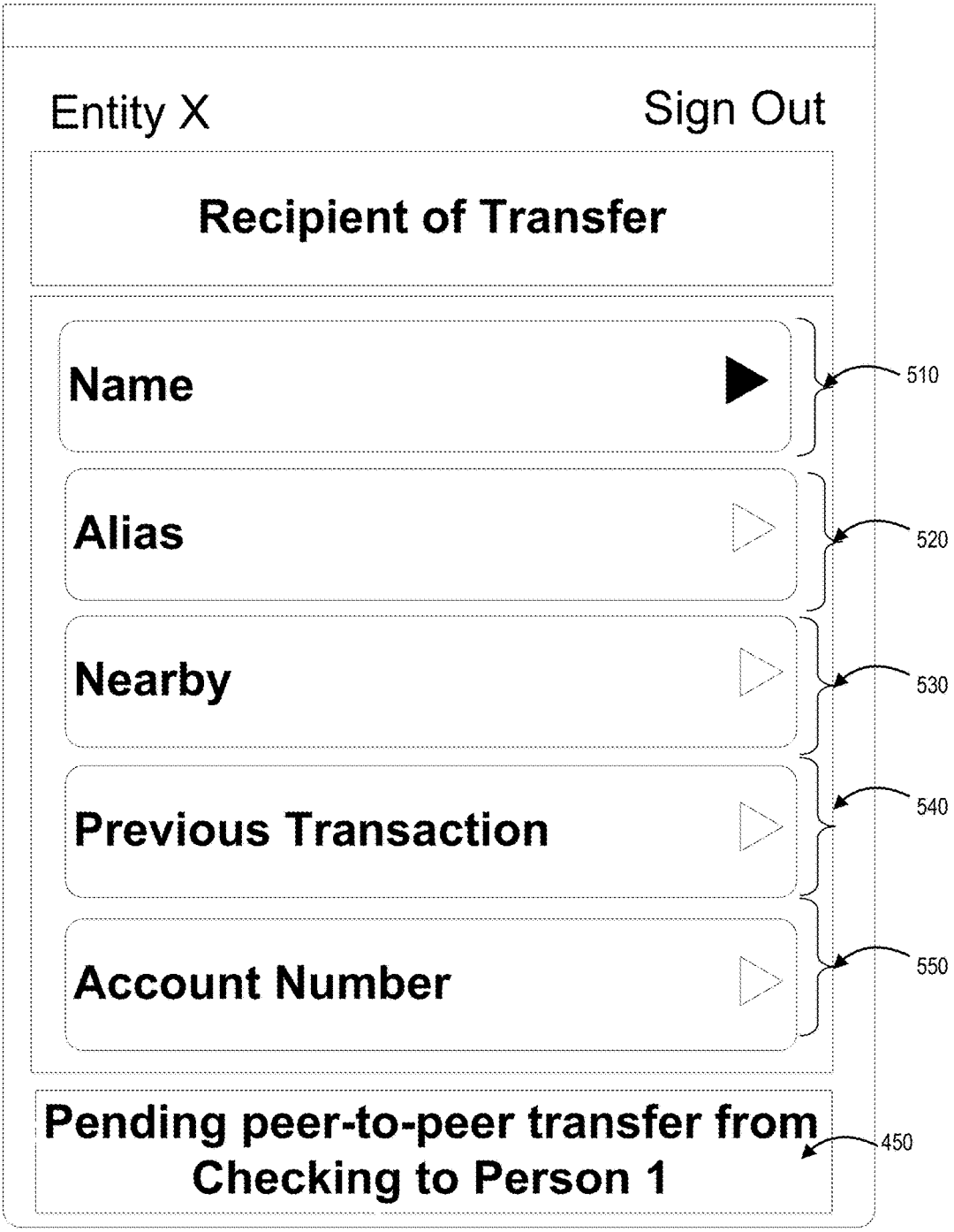
Figure 6:
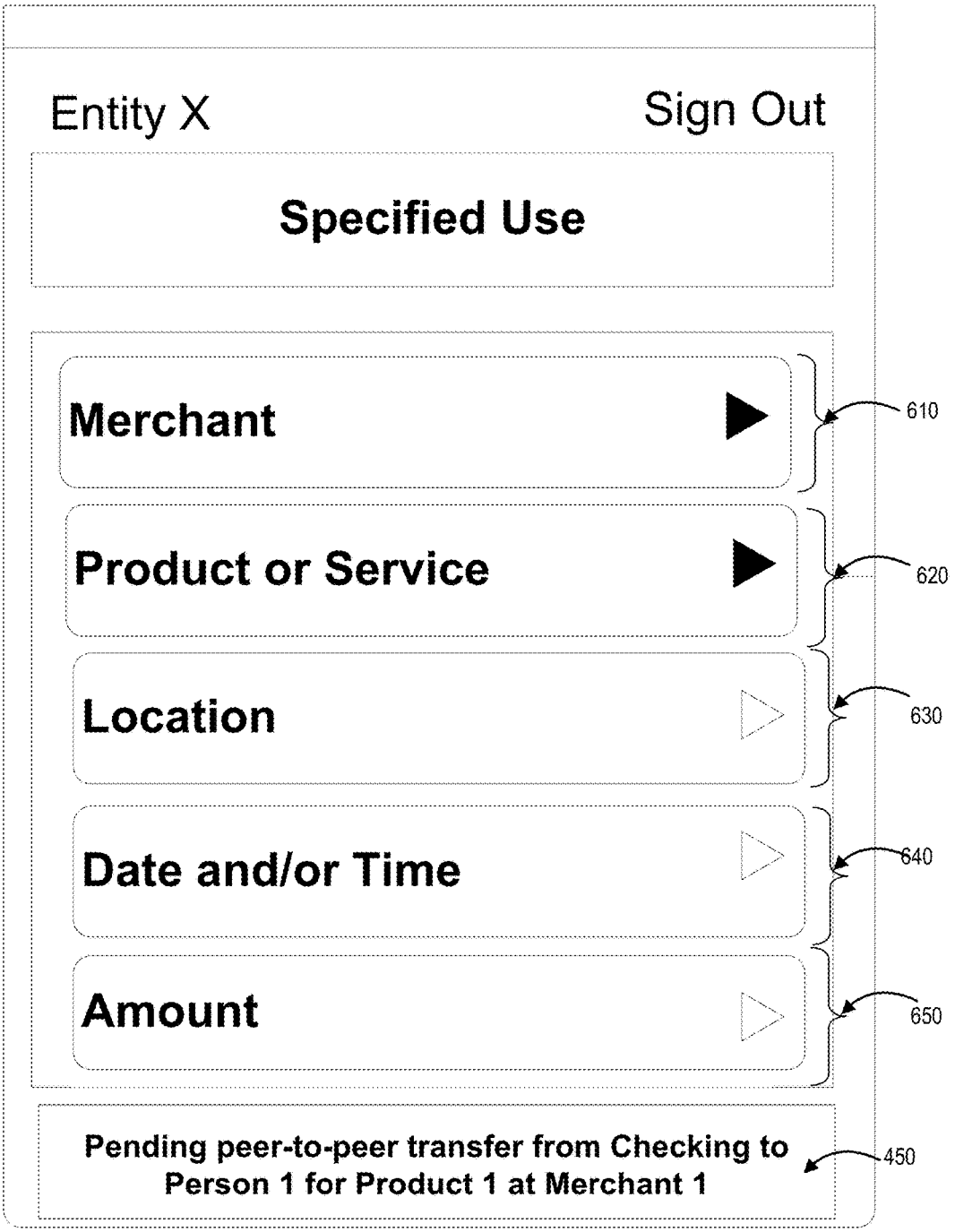
Figure 7:
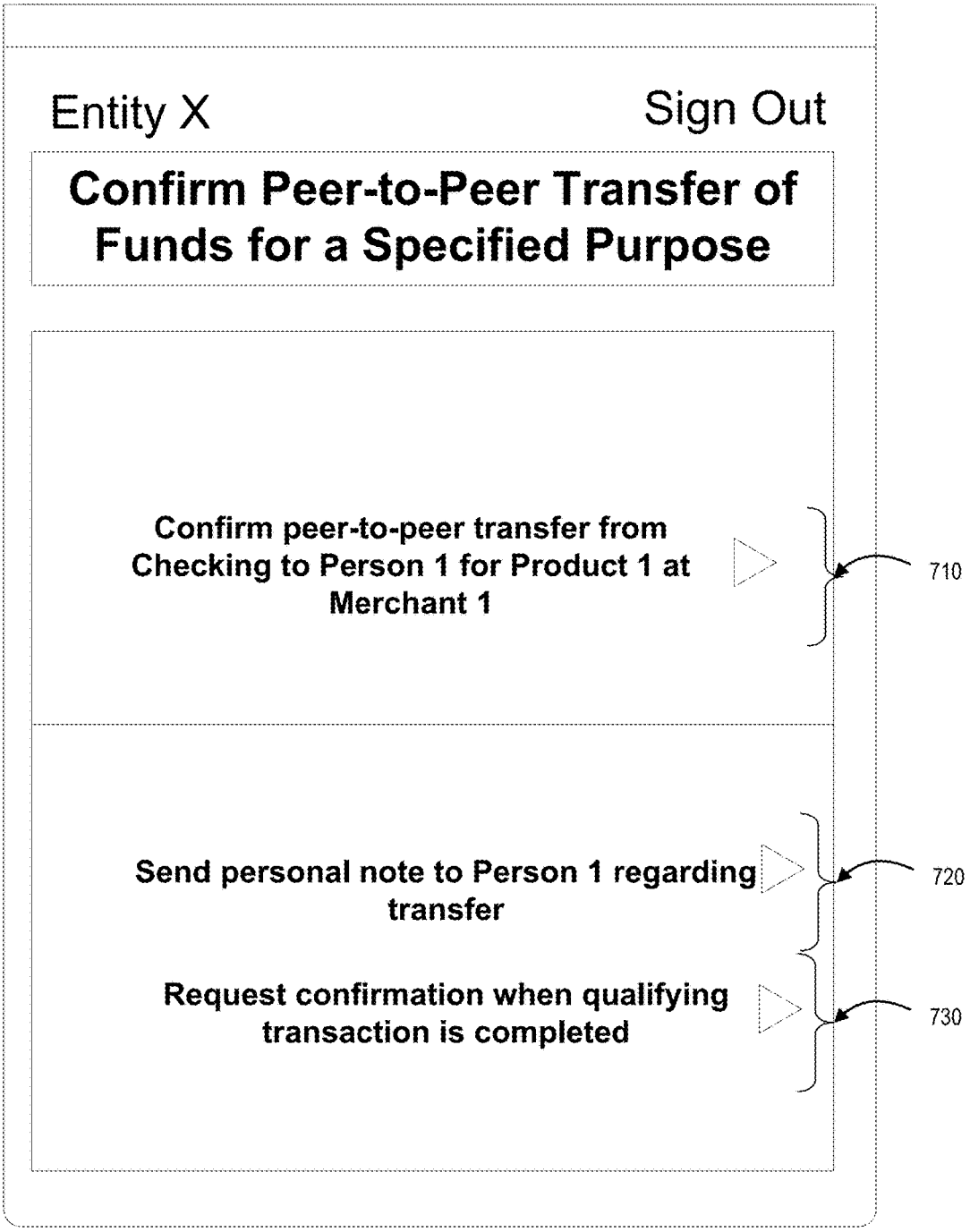

Referring now to FIGS. 4-7, FIGS. 4-7 are exemplary user interfaces for implementing peer-to-peer transfer of funds, in accordance with embodiments of the present invention. In one embodiment, a user authenticates the user's identity to receive access to the user interfaces for implementing peer-to-peer transfer of funds. Once the user is authenticated, the user may select the account to transfer the funds from (FIG. 4), the recipient of the transfer (FIG. 5), the specified use for the funds (FIG. 6), and a confirmation page (FIG. 7). It should be understood that the order of the screens may be changed, such as the recipient may be determined prior to the account that the funds will be transferred from.

Figure 4:
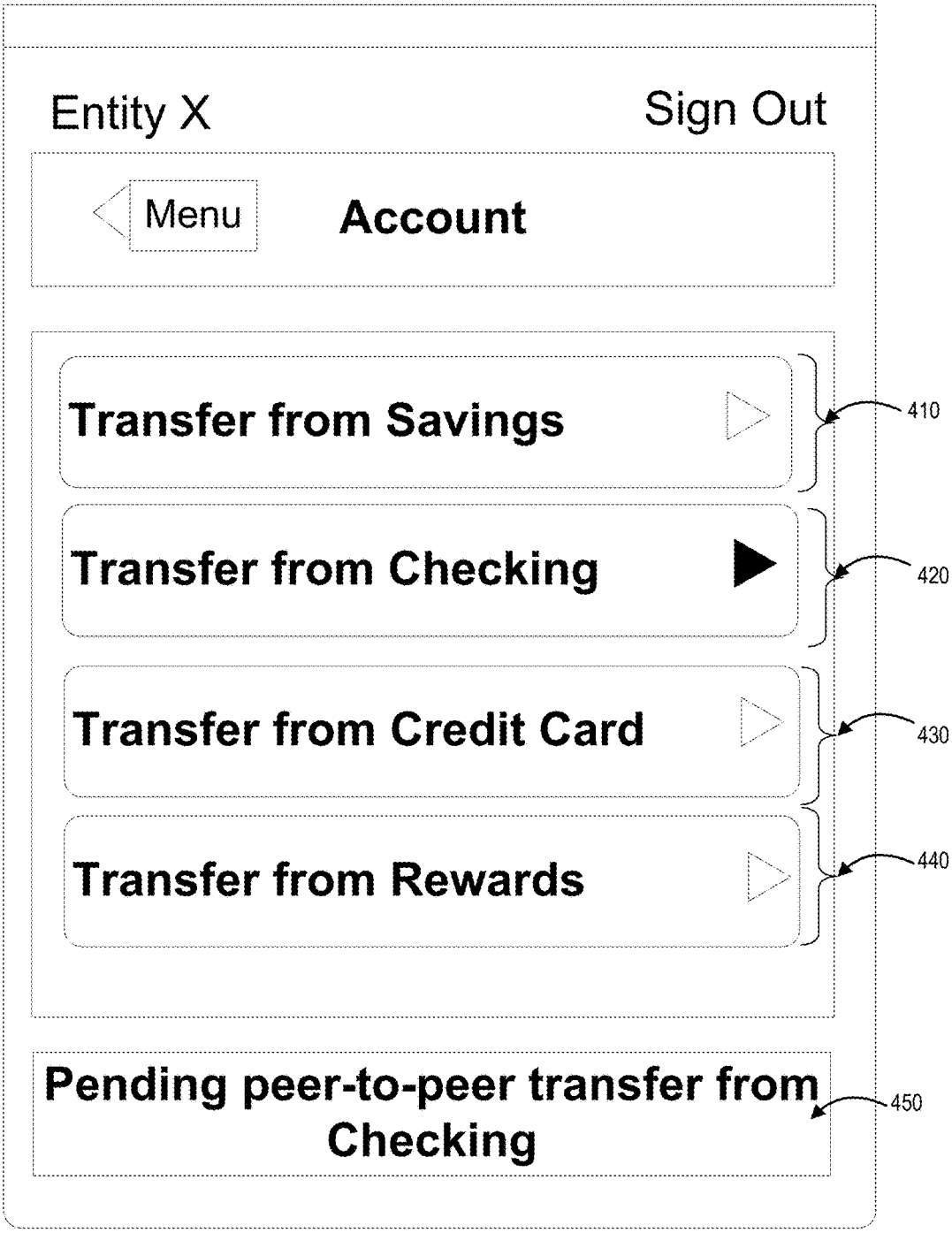

In FIG. 4, an exemplary user interface is provided that allows the user to select which account the funds for the peer-to-peer transfer will be transferred from. In an embodiment, the user may select between a savings account 410, a checking account 420, a credit card account 430, and a rewards account 440. In some embodiments, a status bar 450 is provided that indicates the user's selections as the peer-to-peer transfer for a specified use is determined.

In FIG. 5, an exemplary user interface is provided that allows the user to select the recipient for the peer-to-peer transfer of funds. For example, the interface may assist users in identifying recipients by name 510, alias 520, nearby recipients 530, previous transactions 540, and/or account number 550. The status bar 450 may continue to provide information on the peer-to-peer transfer of funds.

FIG. 6 provides an exemplary user interface that allows user to select the specified use for the funds. The specified use may be for use at a merchant 610, for a specific product or service 620, at a certain location 630, at a certain time 640 (including an expiry time), and/or include an amount 650 (including a maximum amount). The status bar 450 may continue to keep the user informed regarding the pending peer-to-peer transfer.

FIG. 7 provides an exemplary user interface that allows a user to confirm a peer-to-peer transfer of funds for a specified use. The user may review the pending transfer and, if all is in order, confirm the transfer 710. The user may also go back through the screens should the user desire to change the pending transfer in any way (e.g., add an amount, or the like). The user may also be provided with the option of sending a personal note to the recipient 720 or requesting confirmation when a qualifying transaction is completed 730. In an embodiment, the recipient must also allow permit notification when a qualifying transaction is completed before the user will receive notification.

Any of the features described herein with respect to a particular process flow are also applicable to any other process flow. In accordance with embodiments of the invention, the term "module" with respect to a system may refer to a hardware component of the system, a software component of the system, or a component of the system that includes both hardware and software. As used herein, a module may include one or more modules, where each module may reside in separate pieces of hardware or software. As used herein, the term "upon" may be substituted with "in response to."

Although many embodiments of the present invention have just been described above, the present invention may be embodied in many different forms and should not be construed as limited to the embodiments set forth herein; rather, these embodiments are provided so that this disclosure will satisfy applicable legal requirements. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more," even though the phrase "one or more" is also used herein. Like numbers refer to like elements throughout.

As will be appreciated by one of ordinary skill in the art in view of this disclosure, the present invention may include and/or be embodied as an apparatus (including, for example, a system, machine, device, computer program product, and/or the like), as a method (including, for example, a business method, computer-implemented process, and/or the like), or as any combination of the foregoing. Accordingly, embodiments of the present invention may take the form of an entirely business method embodiment, an entirely software embodiment (including firmware, resident software, micro-code, stored procedures in a database, or the like), an entirely hardware embodiment, or an embodiment combining business method, software, and hardware aspects that may generally be referred to herein as a "system." Furthermore, embodiments of the present invention may take the form of a computer program product that includes a computer-readable storage medium having one or more computer-executable program code portions stored therein. As used herein, a processor, which may include one or more processors, may be "configured to" perform a certain function in a variety of ways, including, for example, by having one or more general-purpose circuits perform the function by executing one or more computer-executable program code portions embodied in a computer-readable medium, and/or by having one or more application-specific circuits perform the function.

It will be understood that any suitable computer-readable medium may be utilized. The computer-readable medium may include, but is not limited to, a non-transitory computer-readable medium, such as a tangible electronic, magnetic, optical, electromagnetic, infrared, and/or semiconductor system, device, and/or other apparatus. For example, in some embodiments, the non-transitory computer-readable medium includes a tangible medium such as a portable computer diskette, a hard disk, a random access memory (RAM), a read-only memory (ROM), an erasable programmable read-only memory (EPROM or Flash memory), a compact disc read-only memory (CD-ROM), and/or some other tangible optical and/or magnetic storage device. In other embodiments of the present invention, however, the computer-readable medium may be transitory, such as, for example, a propagation signal including computer-executable program code portions embodied therein.

One or more computer-executable program code portions for carrying out operations of the present invention may include object-oriented, scripted, and/or unscripted programming languages, such as, for example, Java, Perl, Smalltalk, C++, SAS, SQL, Python, Objective C, JavaScript, and/or the like. In some embodiments, the one or more computer-executable program code portions for carrying out operations of embodiments of the present invention are written in conventional procedural programming languages, such as the "C" programming languages and/or similar programming languages. The computer program code may alternatively or additionally be written in one or more multi-paradigm programming languages, such as, for example, F#.

Some embodiments of the present invention are described herein with reference to flowchart illustrations and/or block diagrams of apparatus and/or methods. It will be understood that each block included in the flowchart illustrations and/or block diagrams, and/or combinations of blocks included in the flowchart illustrations and/or block diagrams, may be implemented by one or more computer-executable program code portions. These one or more computer-executable program code portions may be provided to a processor of a general purpose computer, special purpose computer, and/or some other programmable data processing apparatus in order to produce a particular machine, such that the one or more computer-executable program code portions, which execute via the processor of the computer and/or other programmable data processing apparatus, create mechanisms for implementing the steps and/or functions represented by the flowchart(s) and/or block diagram block(s).

The one or more computer-executable program code portions may be stored in a transitory and/or non-transitory computer-readable medium (e.g., a memory or the like) that can direct, instruct, and/or cause a computer and/or other programmable data processing apparatus to function in a particular manner, such that the computer-executable program code portions stored in the computer-readable medium produce an article of manufacture including instruction mechanisms which implement the steps and/or functions specified in the flowchart(s) and/or block diagram block(s).

The one or more computer-executable program code portions may also be loaded onto a computer and/or other programmable data processing apparatus to cause a series of operational steps to be performed on the computer and/or other programmable apparatus. In some embodiments, this produces a computer-implemented process such that the one or more computer-executable program code portions which execute on the computer and/or other programmable apparatus provide operational steps to implement the steps specified in the flowchart(s) and/or the functions specified in the block diagram block(s). Alternatively, computer-implemented steps may be combined with, and/or replaced with, operator- and/or human-implemented steps in order to carry out an embodiment of the present invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An apparatus for providing a peer-to-peer transfer of funds for a specified use, the apparatus comprising:

a memory;

a processor; and a module stored in the memory, executable by the processor, and configured to:

receive information from a user relating to a peer-to-peer transfer of funds, wherein the information comprises a financial institution account associated with the user, a financial institution account associated with a recipient, an amount of funds being transferred, and one or more aspects of specified use of the funds, wherein the one or more aspects of specified use comprises at least one of a type of merchant associated with the use of funds, a specific merchant associated with the use of funds, a product or service associated with the use of funds, a category of a product or service associated with the use of funds, a time period associated with the use of funds, and a location associated with the use of funds;

determine that the recipient is conducting a purchase with a merchant using a payment method associated with the financial institution account associated with the recipient;

receive one or more characteristics associated with the purchase being conducted by the recipient, wherein the received one or more characteristics comprise at least one of a type of merchant associated with the purchase, a specific merchant associated with the purchase, a product or service associated with the purchase, a category of a product or service associated with the purchase, a time period associated with the purchase, and a location associated with the purchase;

compare the one or more received characteristics associated with the purchase with the one or more aspects of specified use of the funds;

in response to comparing the one or more received characteristics associated with the purchase with the one or more aspects of specified use of the funds, determine a characteristic-aspect match, wherein at least one of the one or more received characteristics associated with the purchase matches with at least one of the one or more aspects of specified use of the funds;

transmit electronic command signals configured to cause a user interface of a user device associated with the user to display a confirmation message to the user in response to the determination of the characteristic-aspect match;

receive an indication from the user interface of the user device that the user has confirmed the peer-to-peer transfer of funds;

transfer the amount of funds from the financial institution account associated with the user to the financial institution account associated with the recipient based on at least the determination of the characteristic-aspect match and the received user confirmation of the peer-to-peer transfer of funds;

determine that a purchase amount associated with the purchase conducted by the recipient is greater than the amount of funds transferred;

apply the amount of funds transferred to the financial institution account associated with the recipient towards completing the purchase with the merchant; and apply general funds associated with the financial institution account associated with the recipient to the purchase with the merchant to complete the transaction, wherein the amount of funds transferred to the financial institution account associated with the recipient are applied prior to applying the general funds associated with the financial institution account.

2. The apparatus of claim 1, wherein the amount of funds transferred from the financial institution account associated with the user to the financial institution account associated with the recipient is a maximum amount of funds associated with the financial institution account associated with the user that are available to transfer to the recipient.

3. The apparatus of claim 1, wherein the payment method comprises at least one of a payment card payment, an electronic funds transfer, and a mobile device payment.

4. A computer program product for providing a peer-to-peer transfer of funds for a specified use, the computer program product comprising:

a non-transitory computer-readable medium comprising a set of codes for causing a computer to:

receive information from a user relating to a peer-to-peer transfer of funds, wherein the information comprises a financial institution account associated with the user, a financial institution account associated with a recipient, an amount of funds being transferred, and one or more aspects of specified use of the funds, wherein the one or more aspects of specified use comprises at least one of a type of merchant associated with the use of funds, a specific merchant associated with the use of funds, a product or service associated with the use of funds, a category of a product or service associated with the use of funds, a time period associated with the use of funds, and a location associated with the use of funds;

determine that the recipient is conducting a purchase with a merchant using a payment method associated with the financial institution account associated with the recipient;

receive one or more characteristics associated with the purchase being conducted by the recipient, wherein the received one or more characteristics comprise at least one of a type of merchant associated with the purchase, a specific merchant associated with the purchase, a product or service associated with the purchase, a category of a product or service associated with the purchase, a time period associated with the purchase, and a location associated with the purchase;

compare the one or more received characteristics associated with the purchase with the one or more aspects of specified use of the funds;

in response to comparing the one or more received characteristics associated with the purchase with the one or more aspects of specified use of the funds, determine a characteristic-aspect match, wherein at least one of the one or more received characteristics associated with the purchase matches with at least one of the one or more aspects of specified use of the funds;

transmit electronic command signals configured to cause a user interface of a user device associated with the user to display a confirmation message to the user in response to the determination of the characteristic-aspect match;

receive an indication from the user interface of the user device that the user has confirmed the peer-to-peer transfer of funds;

transfer the amount of funds from the financial institution account associated with the user to the financial institution account associated with the recipient based on at least the determination of the characteristic-aspect match and the received user confirmation of the peer-to-peer transfer of funds;

determine that a purchase amount associated with the purchase conducted by the recipient is greater than the amount of funds transferred;

apply the amount of funds transferred to the financial institution account associated with the recipient towards completing the purchase with the merchant; and apply general funds associated with the financial institution account associated with the recipient to the purchase with the merchant to complete the transaction, wherein the amount of funds transferred to the financial institution account associated with the recipient are applied prior to applying the general funds associated with the financial institution account.

5. The computer program product of claim 4, wherein the amount of funds transferred from the financial institution account associated with the user to the financial institution account associated with the recipient is a maximum amount of funds associated with the financial institution account associated with the user that are available to transfer to the recipient.

6. The computer program product of claim 4, wherein the payment method comprises at least one of a payment card payment, an electronic funds transfer, and a mobile device payment.

7. A computer implemented method for providing a peer-to-peer transfer of funds for a specified use, the computer implemented method comprising:

receiving, using a computing device processor, information from a user relating to a peer-to-peer transfer of funds, wherein the information comprises a financial institution account associated with the user, a financial institution account associated with a recipient, an amount of funds being transferred, and one or more aspects of specified use of the funds, wherein the one or more aspects of specified use comprises at least one of a type of merchant associated with the use of funds, a specific merchant associated with the use of funds, a product or service associated with the use of funds, a category of a product or service associated with the use of funds, a time period associated with the use of funds, and a location associated with the use of funds;

storing, using the computing device processor, the information in association with the recipient account in a database;

determining, using the computing device processor, that the recipient is conducting a purchase with a merchant using a payment method associated with the financial institution account associated with the recipient;

receiving, using the computing device processor, one or more characteristics associated with the purchase being conducted by the recipient, wherein the received one or more characteristics comprise at least one of a type of merchant associated with the purchase, a specific merchant associated with the purchase, a product or service associated with the purchase, a category of a product or service associated with the purchase, a time period associated with the purchase, and a location associated with the purchase;

comparing, using the computing device processor, the one or more received characteristics associated with the purchase with the one or more aspects of specified use of the funds;

in response to comparing the one or more received characteristics associated with the purchase with the one or more aspects of specified use of the funds, determining, using the computing device processor, a characteristic-aspect match, wherein at least one of the one or more received characteristics associated with the purchase matches with at least one of the one or more aspects of specified use of the funds;

transmitting, using the computing device processor, electronic command signals configured to cause a user interface of a user device associated with the user to display a confirmation message to the user in response to the determination of the characteristic-aspect match;

receiving, using the computing device processor, an indication from the user interface of the user device that the user has confirmed the peer-to-peer transfer funds;

transferring, using the computing device processor, the amount of funds from the financial institution account associated with the user to the financial institution account associated with the recipient based on at least the determination of the characteristic-aspect match and the received user confirmation of the peer-to-peer transfer of funds;

determining, using the computing device processor, that a purchase amount associated with the purchase conducted by the recipient is greater than the amount of funds transferred;

applying, using the computing device processor, the amount of funds transferred to the financial institution account associated with the recipient towards completing the purchase with the merchant; and applying, using the computing device processor, general funds associated with the financial institution account associated with the recipient to the purchase with the merchant to complete the transaction, wherein the amount of funds transferred to the financial institution account associated with the recipient are applied prior to applying the general funds associated with the financial institution account.

8. The computer implemented method of claim 7, wherein the amount of funds transferred from the financial institution account associated with the user to the financial institution account associated with the recipient is a maximum amount of funds associated with the financial institution account associated with the user that are available to transfer to the recipient.

* * * * *